US012196213B2

(12) United States Patent
Allred

(10) Patent No.: US 12,196,213 B2
(45) Date of Patent: Jan. 14, 2025

(54) ACTIVITY POOL AXIAL FLOW PUMP

(71) Applicant: AF5, LLC, Lehi, UT (US)

(72) Inventor: Mark Allred, Lehi, UT (US)

(73) Assignee: AF5, LLC, Lehi, UT (US)

( * ) Notice: Subject to any disclaimer, the term of this patent is extended or adjusted under 35 U.S.C. 154(b) by 235 days.

(21) Appl. No.: 17/010,815

(22) Filed: Sep. 2, 2020

(65) Prior Publication Data

US 2020/0400151 A1 Dec. 24, 2020

Related U.S. Application Data

(63) Continuation-in-part of application No. 16/845,042, filed on Apr. 9, 2020, now abandoned, and a continuation-in-part of application No. 16/845,044, filed on Apr. 9, 2020, and a continuation-in-part of application No. 16/845,040, filed on Apr. 9, 2020, now abandoned.

(60) Provisional application No. 62/894,955, filed on Sep. 2, 2019, provisional application No. 62/832,233, filed on Apr. 10, 2019.

(51) Int. Cl.

| | |
|---|---|
| ***F04D 25/06*** | (2006.01) |
| ***E04H 4/00*** | (2006.01) |
| ***E04H 4/12*** | (2006.01) |
| ***F04D 19/00*** | (2006.01) |

(52) U.S. Cl.

CPC ..... *F04D 25/0686* (2013.01); *E04H 4/1245* (2013.01); *F04D 19/00* (2013.01); *E04H 4/0006* (2013.01)

(58) Field of Classification Search

CPC ... F04D 25/0686; F04D 25/00; E04H 4/1245; E04H 4/0006

USPC ..... 417/423.3

See application file for complete search history.

(56) References Cited

U.S. PATENT DOCUMENTS

| | | | |
|---|---|---|---|
| 3,041,631 | A | 7/1962 | Fogle |
| 3,670,343 | A | 6/1972 | Gansloser |

(Continued)

FOREIGN PATENT DOCUMENTS

| | | | |
|---|---|---|---|
| FR | 3054536 | A1 | 2/2018 |
| WO | 2016162704 | A2 | 10/2016 |

OTHER PUBLICATIONS

Final Office Action in U.S. Appl. No. 16/845,040 dated Nov. 24, 2023, 42 pages.

(Continued)

*Primary Examiner* — Erin Deery
*Assistant Examiner* — William R Klotz

(57) ABSTRACT

Some embodiments include an axial flow pump for a activity pool. An axial flow pump, for example, may include a water reservoir and a pump body disposed within the water reservoir. The pump body may include a shaft seal, a water flow intake, and a water flow output. The axial flow pump, for example, may also include an impeller disposed within the pump body between the water flow intake and the water flow output; an electric motor disposed external to the pump body and external to the water reservoir and a shaft that is coupled with the electric motor, extends into the pump body through the shaft seal and is coupled with the impeller such that the electric motor rotates the impeller causing water to flow into the pump body through the water flow intake and forcing the water to exit the pump body through the water flow output.

16 Claims, 15 Drawing Sheets

(56) References Cited

U.S. PATENT DOCUMENTS

| | | | | |
|---|---|---|---|---|
| 3,868,732 | A | 3/1975 | Engelhart | |
| 4,271,542 | A | 6/1981 | Wood et al. | |
| 4,665,572 | A * | 5/1987 | Davidson | A61H 33/0091 4/491 |
| 4,937,896 | A | 7/1990 | Niimura | |
| 4,979,243 | A * | 12/1990 | Teratsuji | A63B 69/125 4/488 |
| 5,487,650 | A * | 1/1996 | Gaston | F02M 37/08 415/72 |
| 5,597,288 | A * | 1/1997 | Hatanaka | F04D 29/606 416/247 R |
| 5,678,253 | A | 10/1997 | Baker | |
| 6,571,403 | B2 | 6/2003 | Wheaton | |
| 6,789,278 | B2 * | 9/2004 | Shea | A63B 69/125 4/492 |
| 7,144,197 | B2 | 12/2006 | Black | |
| 7,526,820 | B2 * | 5/2009 | Murdock | E04H 4/144 4/492 |
| 7,908,682 | B2 | 3/2011 | Sullivan | |
| 8,348,606 | B2 * | 1/2013 | Gopalan | F04D 29/426 415/206 |
| 8,499,373 | B2 | 8/2013 | Saviano | |
| 9,068,371 | B2 | 6/2015 | McFarland | |
| 9,316,010 | B2 | 4/2016 | Perrier et al. | |
| 10,287,793 | B1 | 5/2019 | Anslem et al. | |
| 10,501,953 | B2 | 12/2019 | Courtaigne | |
| 2008/0016610 | A1 * | 1/2008 | Kuo | A63B 69/125 4/488 |
| 2009/0126096 | A1 | 5/2009 | Bocos | |
| 2009/0169305 | A1 | 7/2009 | Lochtefeld | |
| 2010/0058528 | A1 | 3/2010 | Clarey | |
| 2016/0002940 | A1 * | 1/2016 | Courtaigne | F04D 29/548 415/220 |
| 2017/0356207 | A1 | 12/2017 | Henry | |
| 2018/0034822 | A1 | 2/2018 | Mistry | |
| 2018/0334822 | A1 | 11/2018 | Kanetis | |
| 2020/0325696 | A1 | 10/2020 | Allred | |
| 2020/0325697 | A1 | 10/2020 | Allred | |
| 2020/0325698 | A1 | 10/2020 | Allred | |

OTHER PUBLICATIONS

Final Office Action in U.S. Appl. No. 16/845,042 dated Nov. 24, 2023, 46 pages.

Final Office Action in U.S. Appl. No. 16/845,044 dated Mar. 25, 2024, 47 pages.

Non-Final Office Action in U.S. Appl. No. 16/845,040 dated Sep. 2, 2021, 17 pages.

Non-Final Office Action in U.S. Appl. No. 16/845,042 dated Sep. 16, 2021, 26 pages.

Non-Final Office Action in U.S. Appl. No. 16/845,044 dated Dec. 22, 2021, 19 pages.

Advisory Action in U.S. Appl. No. 16/845,044 dated Aug. 2, 2024, 4 pages.

Non-Final Office Action in U.S. Appl. No. 16/845,044 dated Sep. 30, 2024, 21 pages.

* cited by examiner

ACTIVITY POOL AXIAL FLOW PUMP

TECHNICAL FIELD

The present invention generally relates to an axial flow pump for an activity pool that produces a large flow rate of water.

BACKGROUND

Some recreational activities require large amounts of flowing water. For example, surfing simulators involve water flowing up an incline at a high rate of speed. The water flow provides enough force to allow an adult to stand on a board and maneuver without grounding out on the incline.

High volume axial-flow pumps can provide such water flows. An axial-flow pump includes a pipe or pump body with an intake and an exit. Water flows through the body using an impeller on a shaft that is driven by a motor. Impellers are typically stainless steel, require some maintenance and have limited lifetimes.

SUMMARY

Some embodiments include an axial flow pump for an activity pool. An axial flow pump, for example, may include a water reservoir and a pump body disposed within the water reservoir. The pump body may include a shaft seal, a water flow intake, and a water flow output. The axial flow pump, for example, may also include an impeller disposed within the pump body between the water flow intake and the water flow output; an electric motor disposed external to the pump body and external to the water reservoir and a shaft that is coupled with the electric motor, extends into the pump body through the shaft seal and is coupled with the impeller such that the electric motor rotates the impeller causing water to flow into the pump body through the water flow intake and forcing the water to exit the pump body through the water flow output.

In some embodiments, the water reservoir comprises a water fill level indicating the level where water fills the water reservoir. In some embodiments, the electric motor is disposed above the water fill level. In some embodiments, the pump body is disposed below the water fill level.

In some embodiments, the water reservoir is at least partially filled with water and the electric motor is not disposed within the water and the pump body is disposed within the water.

In some embodiments, the axial flow pump includes one or more shaft supports disposed within the pump body and coupled with the shaft to allow the shaft to rotate and remain aligned between the electric motor and the impeller.

In some embodiments, the axial flow pump includes one or more stater veins disposed between the water flow intake and the impeller.

In some embodiments, the axial flow pump includes comprising one or more stater veins disposed between the impeller and the water flow output.

In some embodiments, the impeller comprises one or more metals from the group consisting of brass, stainless, nickel, aluminum, and bronze. In some embodiments, the impeller comprises a non-metal composite material.

In some embodiments, the axial flow pump includes a speed reducing box coupled with the motor and the shaft, the speed reducing box reduces the rotational speed of the shaft and the impeller with respect to the rotational speed provided by the motor.

In some embodiments, the impeller comprises an impeller flange and a plurality of composite impeller blades, the impeller flange may be coupled with the shaft and the plurality of impeller blades.

In some embodiments, in the shaft is disposed perpendicular relative to the direction of the water flow as it exits the pump body via the water flow output.

Some embodiments of the invention are directed to an impeller that is not made of stainless steel. Some embodiments include an impeller that is made of non-metal composite materials. A composite impeller, for example, may reduce the weight of the impeller blade. As another example, a composite impeller may reduce the amount of maintenance required for the impeller due to the lack of metal elements in the impeller blades. An impeller blade, for example, may also include protective laminates or other synthetic fibers such as, for example, Kevlar®. A composite impellers may also take advantage of different methods of design and customization that may not be fully available to steel impellers.

In some embodiments, an axial flow pump may include a body comprising a water flow intake and a water exit. An axial flow pump may include a shaft configured to be driven by a motor. An axial flow pump may include an impeller coupled to the shaft, where the impeller includes formed composite blades. An axial flow pump may include an impeller having an composite hub. An axial flow pump may include a pump body that includes a composite material.

In some embodiments, a impeller blade may include a carbon fiber core shaped as an axial flow blade, a protective laminate skin over the carbon fiber core, and a flange perpendicular to the hub-side edge for attachment to the hub.

In some embodiments, an outer edge of the impeller blade may be thinner than a core of the blade and the outer edge twists such that leading and following corners of the blade bend slightly towards adjacent blades on the hub. Other embodiments include hub and blade designs as shown in the figures.

In some embodiments, a method of forming a composite impeller blade includes layering carbon fiber in the shape of an axial flow blade core, where the axial flow blade core has an attachment flange along the length of the blade and extending perpendicularly from an inner edge of the blade proximal to an impeller hub, and where the attachment flange is configured to attach to a side of the impeller hub. The method includes covering the carbon fiber layers with epoxy resin, vacuum forming the layers to form a composite impeller blade and vacuum forming protective laminate layers over the composite impeller blade.

In some embodiments, the method may include forming the composite impeller blade such that an outer edge of the composite impeller blade is thinner than a core of the blade and the outer edge twists such that leading and following corners of the blade bend slightly towards adjacent blades on the hub. The method may also include forming the composite impeller blade according to the shape, dimensions and design illustrated in the figures.

The invention is not limited to the above features and advantages. Those of ordinary skill in the art will recognize additional features and advantages upon reading the following detailed description, and upon viewing the accompanying drawings.

DETAILED DESCRIPTION

Some embodiments are directed toward an axial flow pump for an activity pool. In some embodiments, the axial flow pump can pump water with a high flow rate. In some embodiments, the axial flow pump may include a water reservoir and a pump body disposed within the water reservoir. The pump body may include a shaft seal, a water flow intake, and a water flow output. The axial flow pump, for example, may also include an impeller disposed within the pump body between the water flow intake and the water flow output; an electric motor disposed external to the pump body and external to the water reservoir, and a shaft that is coupled with the electric motor, extends into the pump body through the shaft seal and is coupled with the impeller. The electric motor may rotate the impeller, which can force water from the water reservoir to flow into the pump body through the water flow intake and forcing the water to exit the pump body through the water flow output.

In some embodiments, portions of the axial flow pump may be designed to be disposed in a water with the water reservoir and other portions of the axial flow pump may be designed to be disposed out of the water. An electric motor, for example, may be disposed outside the water reservoir or outside the water reservoir water level, and an impeller and pump body may be placed within the water reservoir or within the water.

Figure 1:
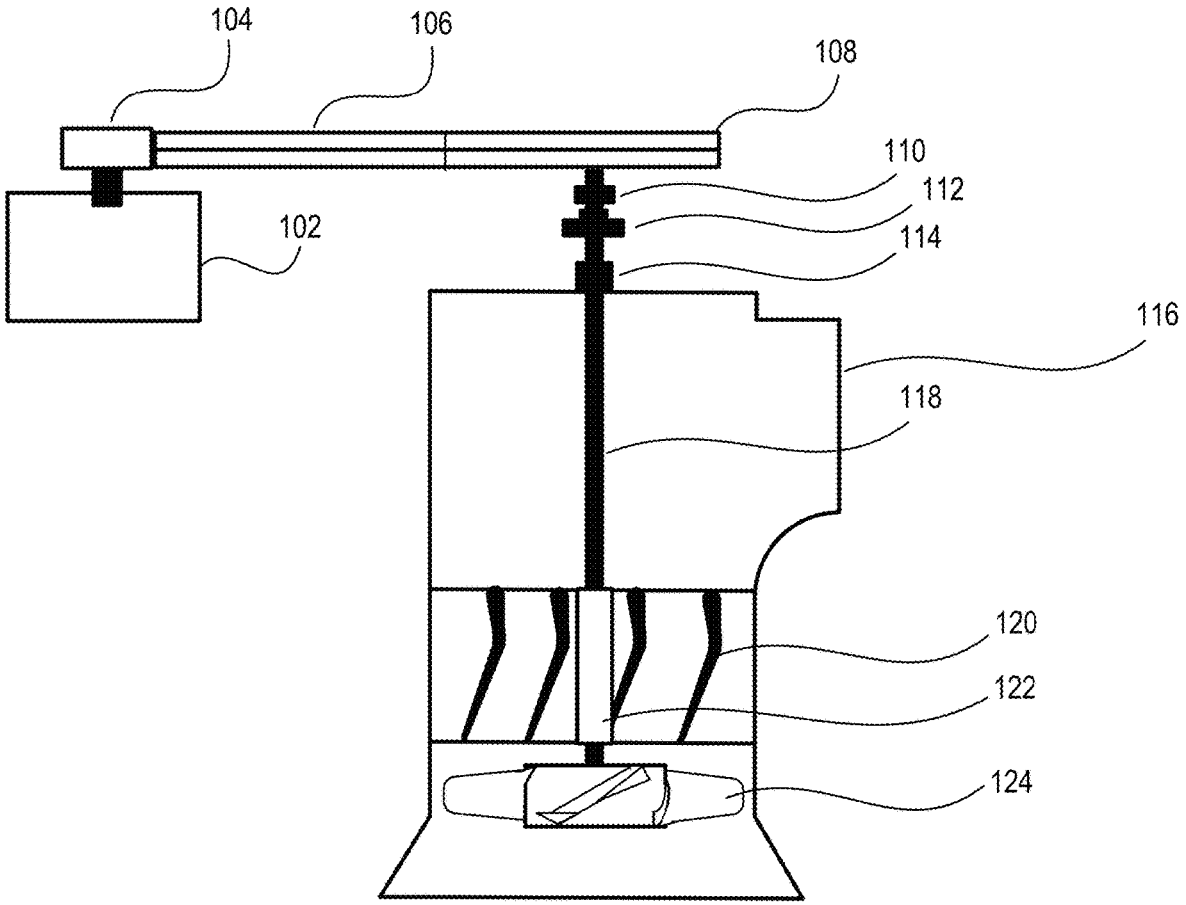
FIG. 1 is a diagram of an axial flow pump, according to some embodiments.

FIG. 1 illustrates an axial flow pump according to some embodiments. An electric motor 102 may be coupled to a driver sheave 104 that uses belt 106 to turn a driven sheave 108. The driver sheave 104 and/or the driven sheave 108, for example, may be a Gates® sheave and/or the belt 106 may be a Gates® belt or the like. The driven sheave 108, for example, may be coupled to a shaft 118 that drives through the center of pump body 116. The Shaft 118 may be driven through the pump body 116 via a shaft seal 114.

The shaft 118, for example, may be stainless steel. The shaft 118 may be about 2.75" in diameter or any size. In some embodiments thrust bearing 110, a flange bearing 112 and/or a shaft seal 114 may be used to secure the shaft 118 in the pump body 116. The shaft 118 may turn the impeller 124. In some embodiments, the cutlass bearings 122 may be used. The shaft seal 114, for example, may include a rotary shaft seal.

In some embodiments, the impeller 124 draws water up through the intake of the pump body 116 and out the pump exit to pump water with a high flow rate. In some embodiments, the stator vanes 120 may be used in the pump body 116 above the impeller 124 to straighten out the swirl flow of the water for improved exit speed.

Figure 2:
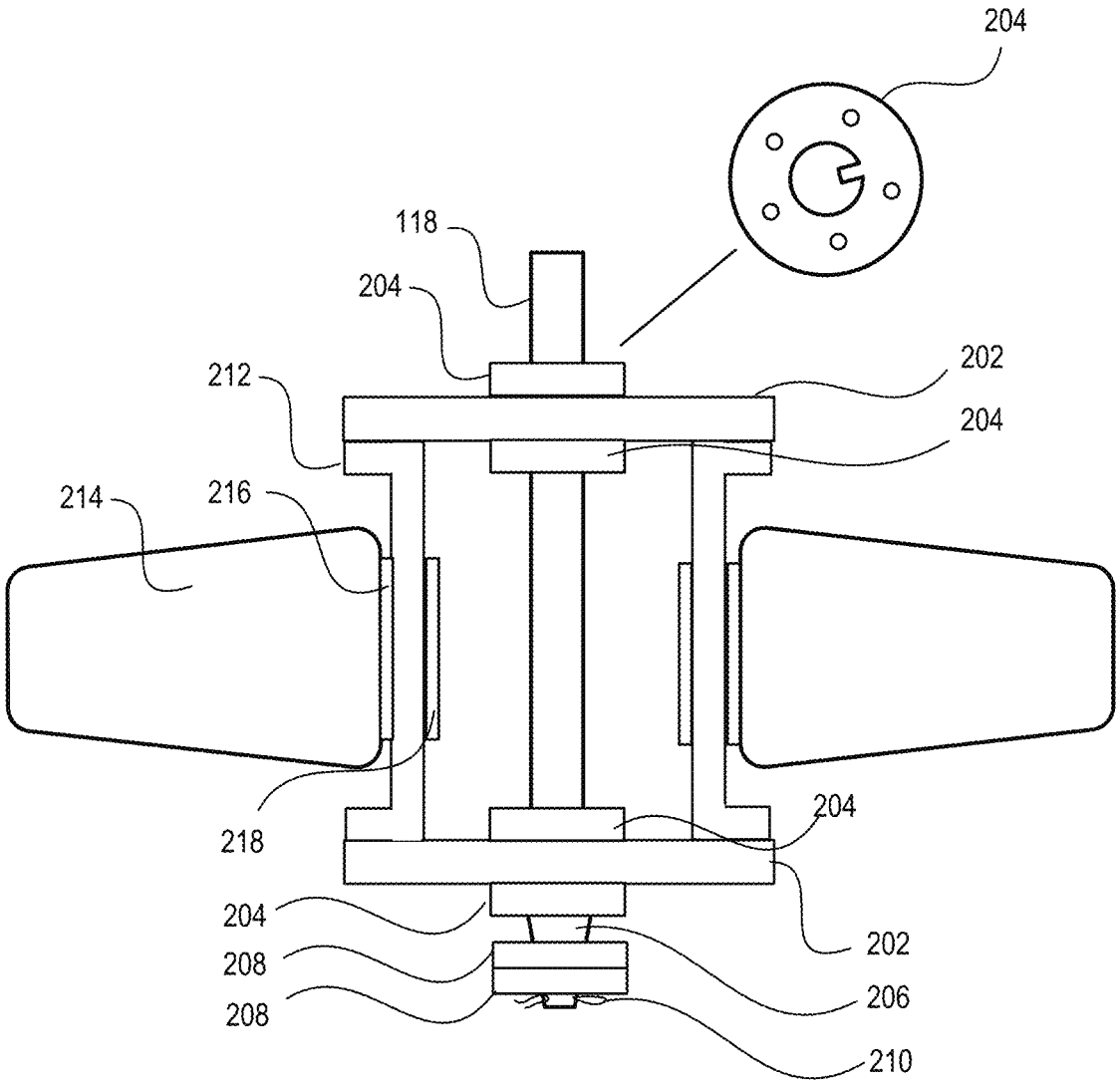
FIG. 2 is a diagram of the composite impeller in the axial flow pump of FIG. 1, according to some embodiments.

FIG. 2 illustrates a diagram of an impeller such as the impeller 124 driven by the shaft 118 according to some embodiments. In some embodiments, marine motor couplings 204 may be used to secure the blade flanges 202 of the hub to the shaft 118. These may be transmission couplers or machined stainless steel. In some embodiments, the couplings 204 are secured together with fasteners (e.g., bolts) and may be keyed, as shown in FIG. 2.

In some embodiments, the bottom 206 of shaft 118 below the hub may be STD tapered per SAE. In some embodiments, the shaft nuts 208 may be used and held in place by a shaft cotter pin 210. In some embodiments, the bottom 206 of shaft 118 may be capped in some embodiments.

In some embodiments the blade flanges 202 may be bolted (with metal backing plates) to the hub wall 212, which may be fiberglass (e.g., e-glass) or another composite material. The impeller blades 214, for example, may be fastened to the hub wall 212 with reinforcing stainless steel plates, for example, to handle the compression force of the metal fasteners. For example, a steel back plate 218 may be on the inside of the hub wall 212 and a steel back plate 216 may be on the outside of hub wall 212. The impeller blade 214, for example, may be secured (e.g., bolted) at its composite flange portion with fasteners through the steel plates 216, 218.

In some embodiments, the impeller 124 is designed to move a large amount of water—about 300,000 gallons a minute. The electric motor 102, for example, may have any horsepower and/or speed such as, for example, 600 hp at 150 rpm. In some embodiments, it may have a 12:1 gear reduction. In some embodiments, the impeller 124 may be have any size such as, for example, about 94" in diameter and/or about 24" in height. The hub may have any size such as, for example, the hub may have a diameter of about 47". The hub may be of any size such as, for example, about 50% of the diameter of impeller 124.

In some embodiments, the impeller blade 214 may be part an axial flow pump or Caplan propeller style that is 1.55" at the center of the blade, but only 0.2" at the tip of the blade.

Figure 3:
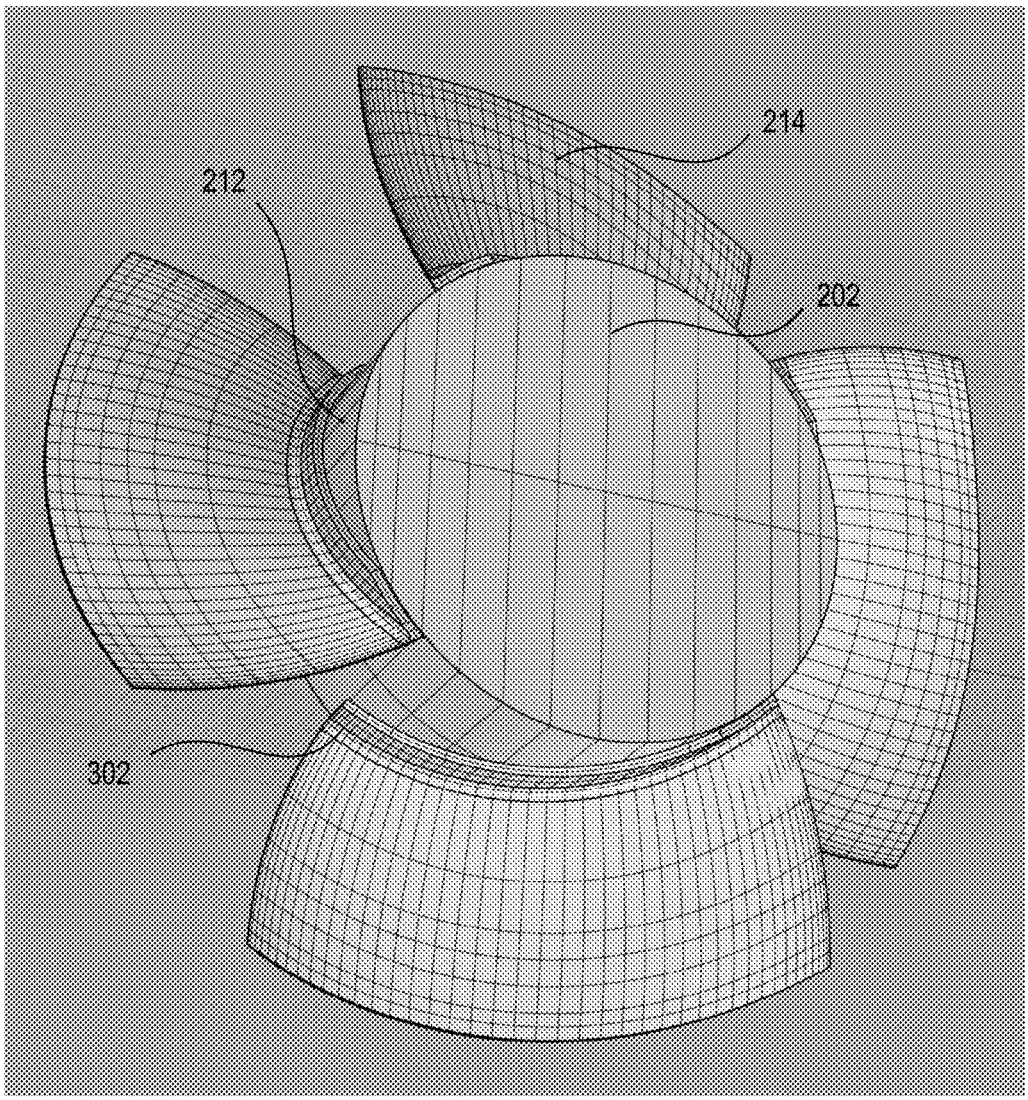
FIG. 3 is a perspective view of the top of an example design of the composite impeller, according to some embodiments.

FIG. 3 illustrates a top view of the impeller 124 according to some embodiments. The blade flange 302, for example, is seen with the hub wall 212. The blade flange 302 can be used to couple the impeller blades 214 to the hub 2.

Figure 4:
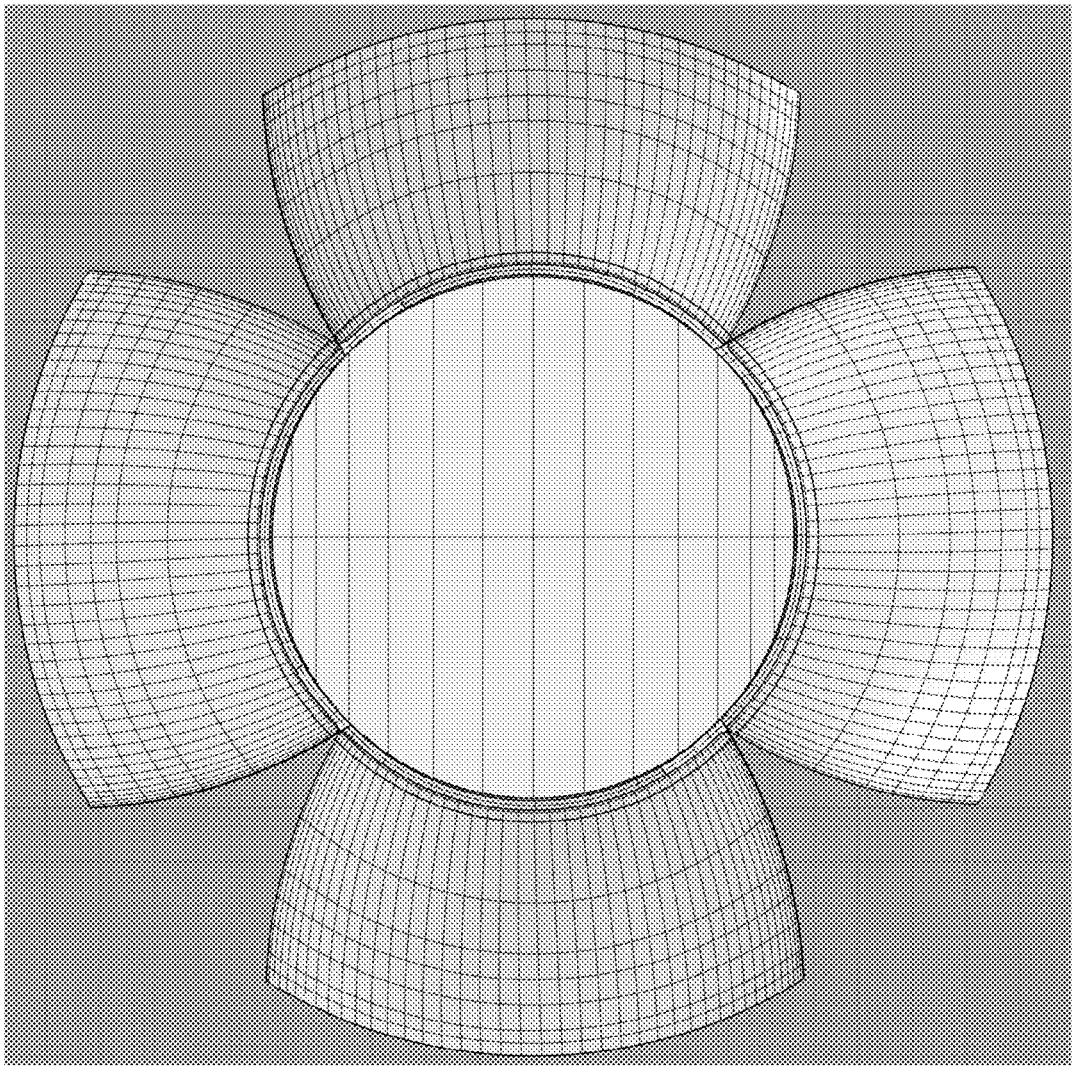
FIG. 4 is a bottom view of the top of the example design of the composite impeller, according to some embodiments.

FIG. 4 is a bottom view of the impeller 124 according to some embodiments.

Figure 5:
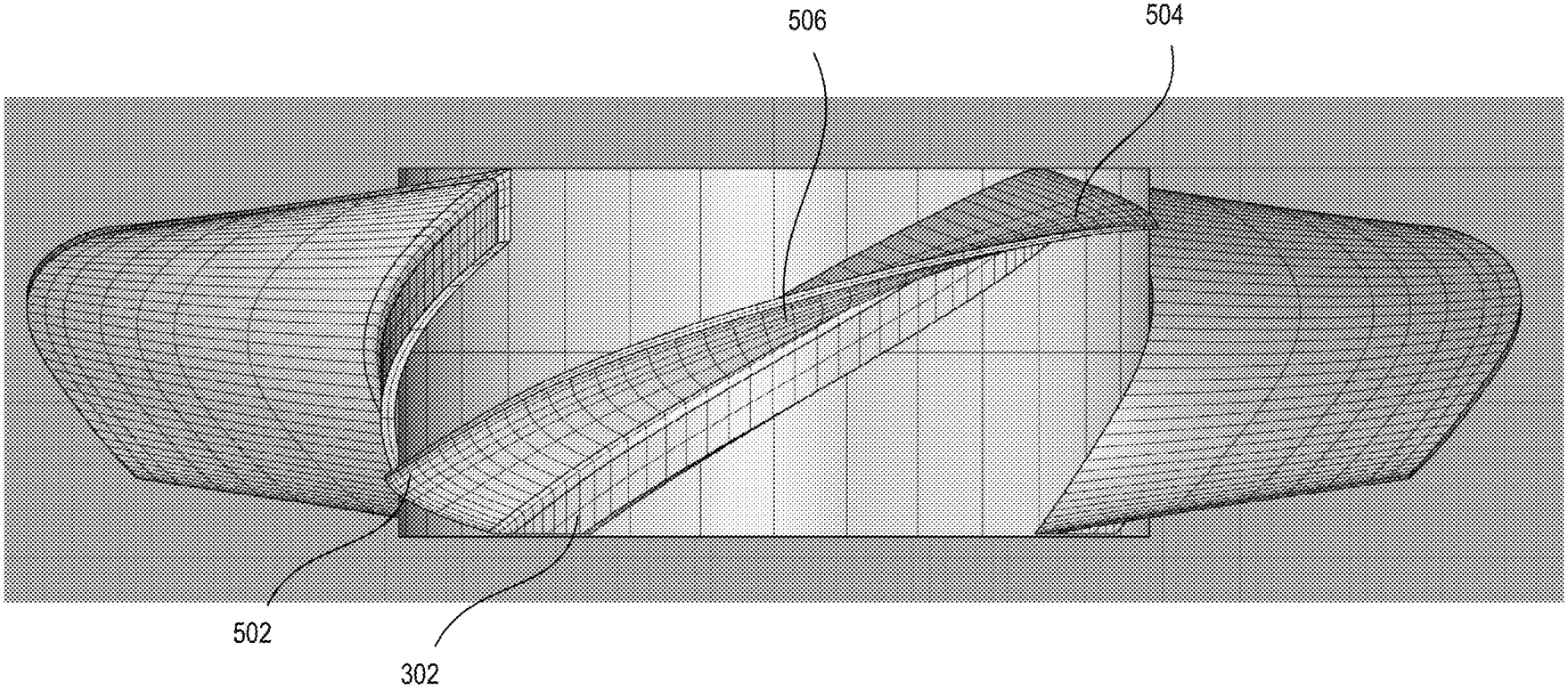
FIG. 5 is a side view of the example design of the composite impeller, according to some embodiments.

FIG. 5 is a side view of the impeller 124 according to some embodiments. The blade flange 302 couples the impeller blade 214 with the hub 202. This view shows a bottom portion of blade 214 that is turned up and towards an adjacent blade to help cut into the water. In some embodiments, the twist 506 in the blade 214 provides for a top portion of the blade 214 that is turned down and towards an adjacent blade to help reduce cavitation, which reduces efficiency and causes vibration and damage to impeller blades.

Figure 6:
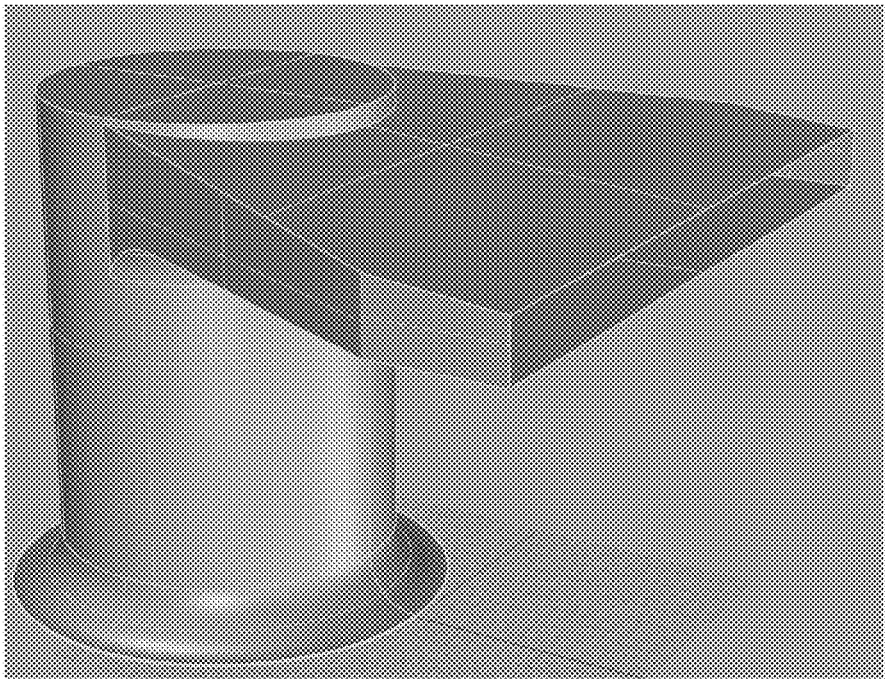
FIG. 6 is a perspective view of a design of the axial flow pump of FIG. 1, according to some embodiments.
Figure 7:
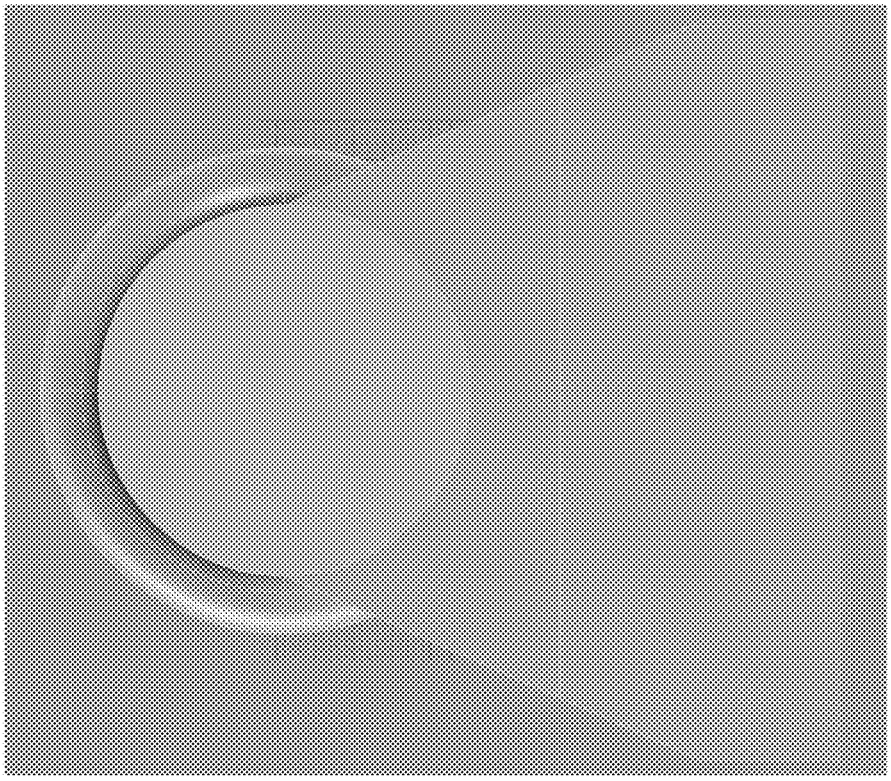
FIG. 7 is an intake view of the axial flow pump, according to some embodiments.
Figure 8:
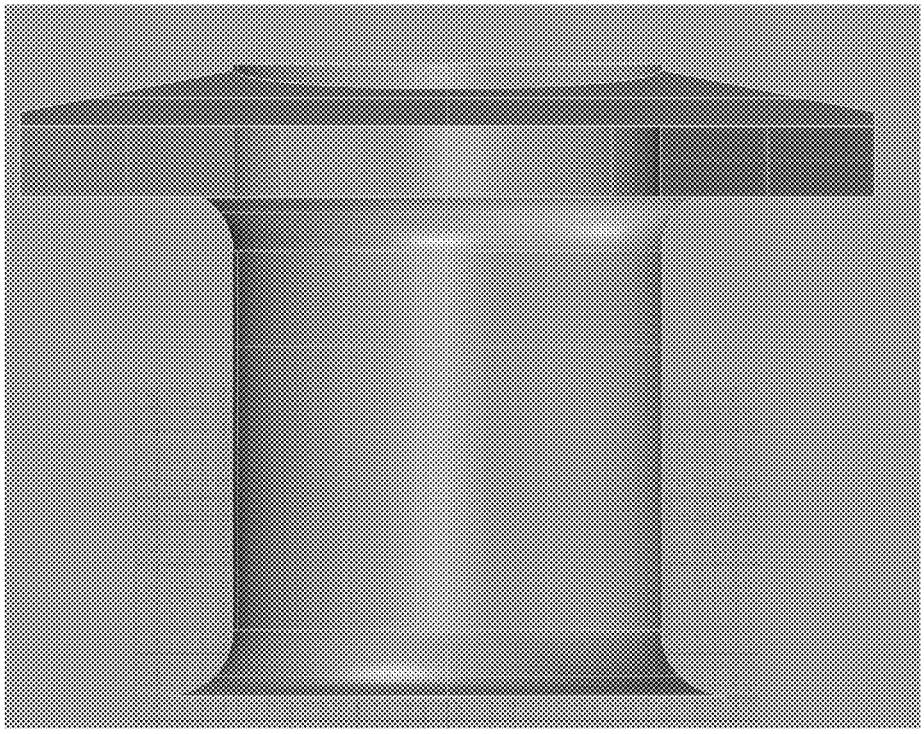
FIG. 8 is a side view of the axial flow pump, according to some embodiments.

FIGS. 6-8 provide additional views of an axial flow pump body 116 according to some embodiments.

Some embodiments include a impeller blade such as, for example, a composite impeller blade. A composite blade, for example, may have a longer life with less maintenance.

Figure 9:
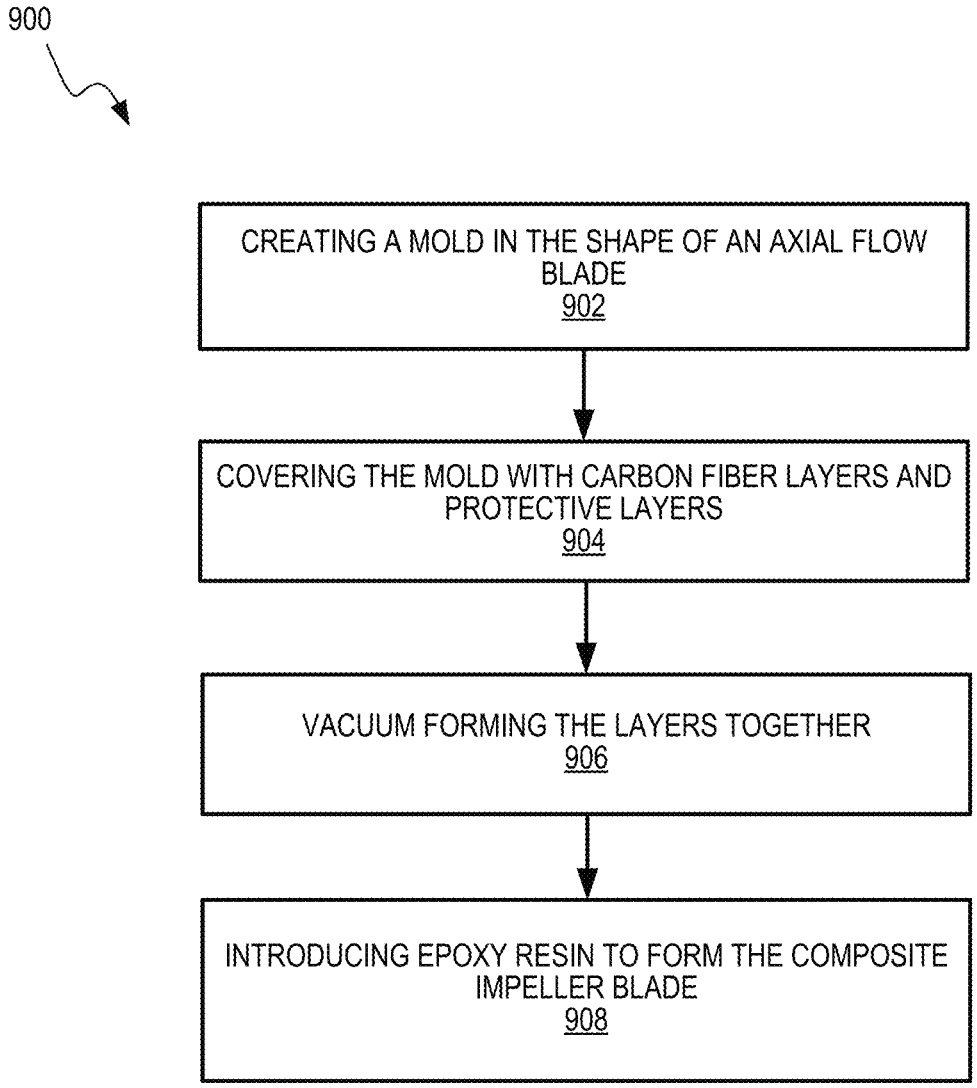
FIG. 9 is a flow chart illustrating an example process of manufacturing a impeller blade, according to some embodiments.

FIG. 9 illustrates a method 900 of forming a impeller blade, such as the blade 214. The core of the blade may be a solid ½" core made of carbon fiber. This may include any number of carbon fiber layers such as, for example, 24 carbon fiber layers at the center and fewer layers towards the edge of the blade. At block 902 of method 900 may include layering carbon fiber layers in the shape of a blade core. This blade will also include a flange for attachment to the hub wall 212.

The carbon fiber layers are covered in epoxy resin (block 904) and they are vacuum formed to form a impeller blade (block 906). Multiple protective layers (e.g., 4 Kevlar layers) may be vacuum formed over the impeller blade to provide a protective coating (block 908).

Figure 10:
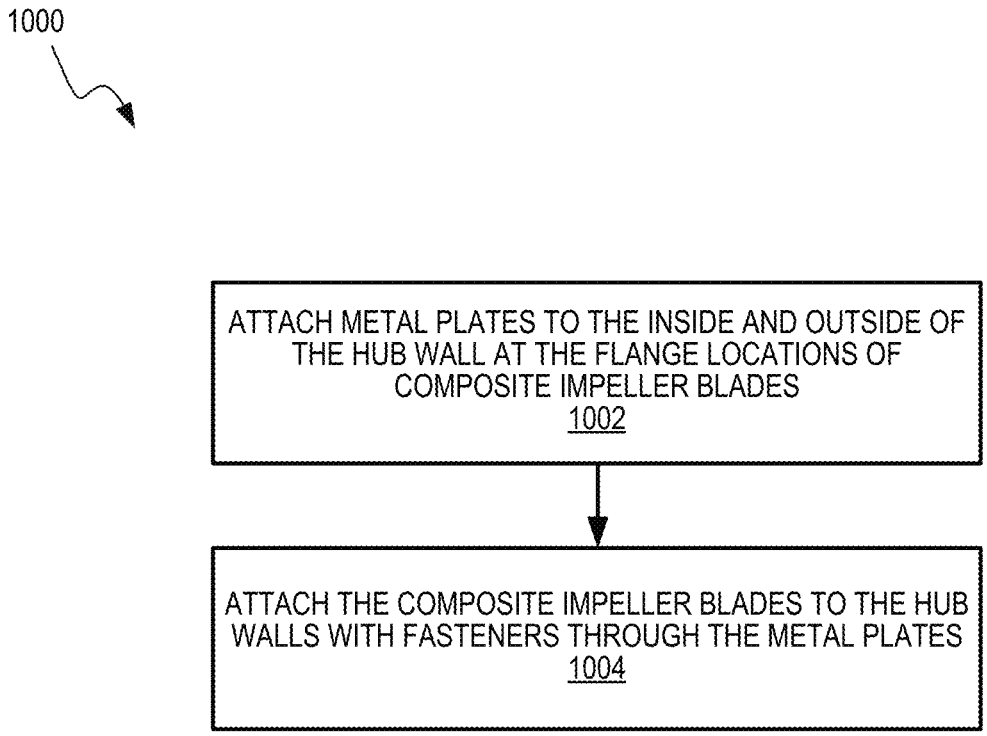
FIG. 10 is a flow chart illustrating an example process of manufacturing the composite impeller, according to some embodiments.

Once the impeller blade is formed, it may be attached to the hub wall 212. For example, FIG. 10 shows these steps for follow on method 1000. At block 1002, metal (e.g., stainless steel) plates are attached to the inside and outside of the hub wall 212, as described for FIG. 2. At block 1004, the impeller blade is attached at its flange to the hub wall with fasteners that pass through the metal plates.

Figure 11:
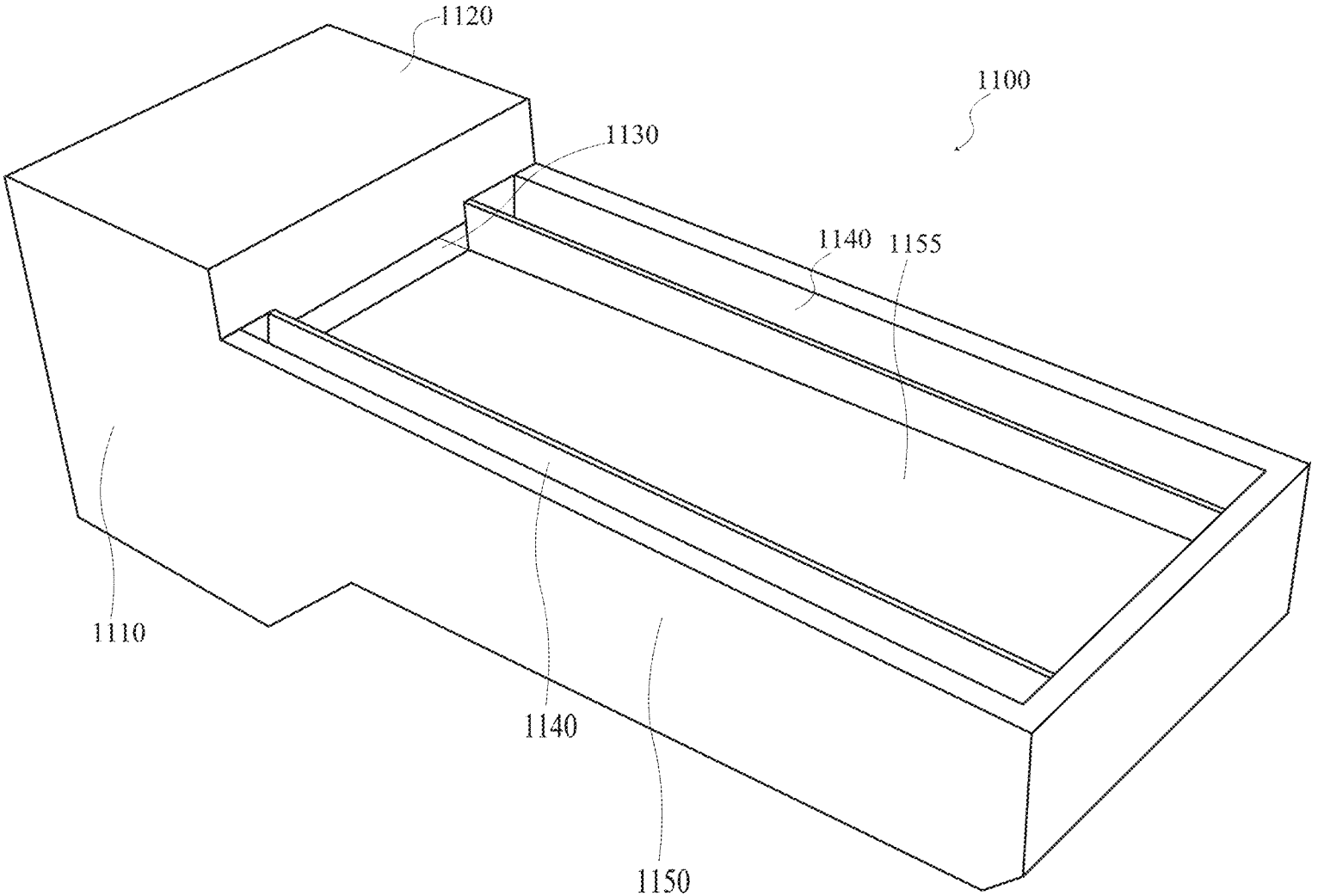
FIG. 11 is an illustration of a perspective view of an activity pool according to some embodiments.

FIG. 11 is an illustration of a perspective view of an activity pool 1100 according to some embodiments. The activity pool 1100 may include a water reservoir 1110, an axial flow pump body 1120 (e.g., pump body 116), an outlet nozzle 1130, one or more water return channels 1140, and an activity pool reservoir 1150. In some embodiments, water may be pumped from the water reservoir 1110, through an intake in an axial flow pump 1160 disposed within the axial flow pump body 1120, out the outlet nozzle 1130 into an activity channel 1155 of the activity pool reservoir 1150. Water may return to the water reservoir 1110 from the activity pool reservoir 1150 via the one or more water return channels 1140. In some embodiments, the axial flow pump 1160 may pump water into the activity channel 1155 of the activity pool reservoir 1150 with a variable flow rate. In other words, the flow may be adjusted based on a user selected activity.

In some embodiments, the activity pool 1100 may include one or more drain gates disposed between the activity pool reservoir 1150 and the one or more water return channels 1140. Water can flow from the activity pool reservoir 1150 back to the water reservoir 1110 via the water return channels 1140.

In some embodiments, water return channels 1140 may be disposed on one or both sides of the activity pool reservoir 1150 and/or the back of the activity pool reservoir 1150. The water return channels 1140 may be fluidically coupled with the water reservoir 1110. Water can flow from the activity pool reservoir 1150 back to the water reservoir 1110 via the water return channels. In some embodiments, the water return channels 1140 may include grates at the top surface of the water return channels 1140. The grates, for example, may be made from fiberglass, ABS plastic, metal, composites, plastics, etc.

In some embodiments, the activity channel 1155 may have longitudinal side walls that span a portion or all of the activity channel 1155 from an end proximate to the outlet nozzle 1130 to a distal end of the activity channel 1155 opposite the outlet nozzle 1130. The activity channel 1155 may have an activity deck which can be adjusted to various heights to create various depths of water in the activity channel 1155. The position of the activity deck may be described as a height (e.g., relative to a bottom surface of the activity pool reservoir 1150) or a depth (e.g., relative to a water surface level within the activity pool reservoir 1150). In some implementations, the activity channel 1155 may have a bottom surface may have a sloped portion at or near the distal end of the activity channel 1155.

The water reservoir 1110 may include an upper portion, a sloped portion and a lower portion. The bottom of the upper portion may be level with the bottom of the activity pool reservoir 1150. This can, for example, guide water in the water reservoir 1110 toward the bell end 1310 at the lower portion of the axial flow pump. In some embodiments, the water reservoir 1110 may be adjacent to the water return channel 1140, rather than directly below the water return channel 1140.

Figure 12:
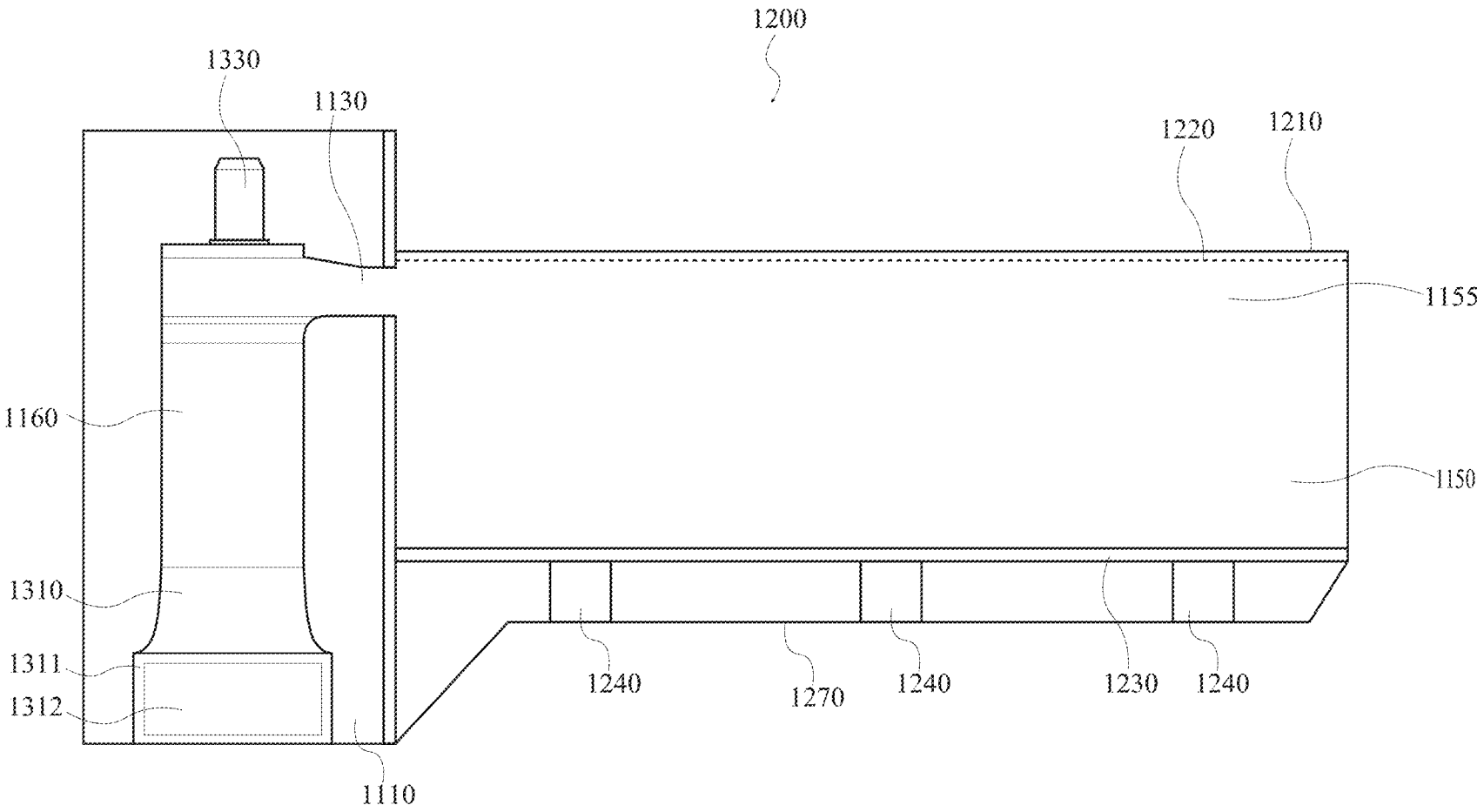
FIG. 12 is an illustration of a side view of an activity pool in a full configuration according to some embodiments.

FIG. 12 is a side view illustration of an activity pool 1100 along a slice down the middle of the activity pool 1100 according to some embodiments. The activity deck 1230 may adjust in height with a plurality of lifts 1240 disposed between the bottom surface of the activity deck 1230 and the bottom surface of the activity pool reservoir 1150. The plurality of lifts 1240 may include a system having one or more axles, acme screws, worm gears, and/or motors that are coupled together to raise and lower the activity deck 1230. The plurality of lifts 1240 may move the activity deck 1230 between different heights to create different activity pool configurations.

Figure 13:
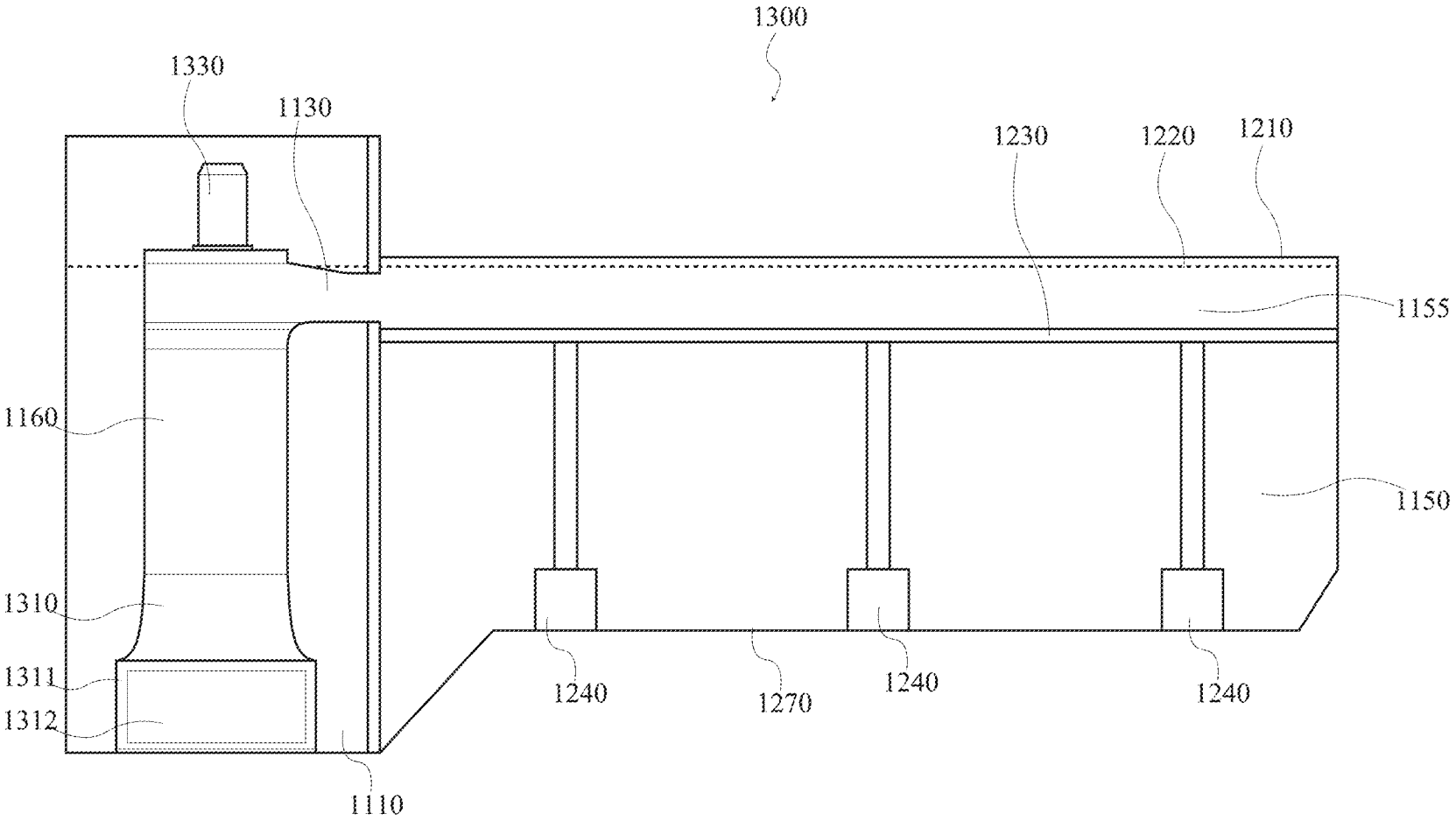
FIG. 13 is an illustration of a side view of an activity pool in a wave pool configuration according to some embodiments.

FIG. 13 shows a side view of the activity pool 1100 in a full pool configuration. In the full pool configuration, for example, the activity deck 1230 may be disposed at or near the bottom of the activity pool reservoir 1150. In the full pool configuration, for example, the plurality of lifts 1240 may be at or near the lowest extended position of each of the plurality of lifts 1240.

In some embodiments, the activity deck 1230 may comprise a main structure comprised of a plurality of steel beams. In some embodiments, the activity deck 1230 may comprise a surface having a plurality of slats or planks that may, for example, be disposed on the plurality of steel beams. In some embodiments, the activity deck 1230 may comprise a plurality of composite members arranged side by side that may, for example, be disposed on the plurality of steel beams. In some embodiments, the activity deck 1230 may comprise a plurality of Trex® decking material that may, for example, be disposed on the plurality of steel beams.

In some embodiments, the activity deck may include a plurality of nut sleeves. The plurality of nut sleeves, for example, may be welded into the activity deck 1230. The accessory mechanisms may include bolts that can be screwed into the nut sleeves to attach the accessory mechanisms to the activity deck.

FIG. 13 shows a side view of the activity pool 1100 in a wave pool configuration according to some embodiments. In the wave pool configuration, the activity deck 1230 may be disposed at height below the water surface 1220 such as, for example, at a height less than 2, 4, 6, 8, 12, 18 inches etc. below the water surface 1220. In the wave pool configuration, the activity deck 1230 may be disposed at height below the top surface 1210 of the activity pool 1100 such as, for example, at a height less than 2, 4, 6, 8, 12, 18 inches etc. below the top surface 1210 of the activity pool 1100. In some embodiments, the top surface 1210 of the activity pool 1100 may be level with the ground surrounding the activity pool 1100.

Figure 14:
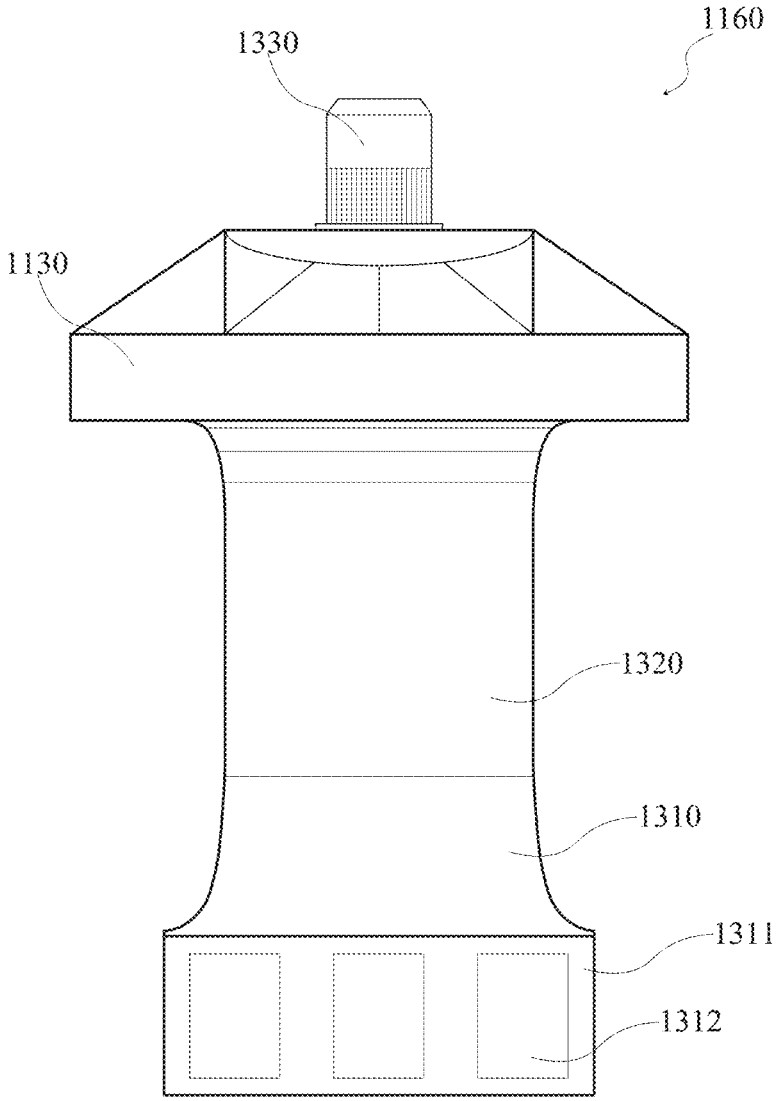
FIG. 14 is a side view of an axial flow pump according to some embodiments.

FIG. 14 is a side view of an axial flow pump 1160 according to some embodiments. The axial flow pump 1160 may include an axial housing that includes a water flow channel 1320, an outlet nozzle 1130, a bell end 1310, a bottom portion 1311, and a apertures 1312. The bell end 1310, for example, may be located near the bottom of the axial flow pump housing. The axial flow pump housing, for example, may include a plurality of apertures 1312 through which water may be pulled from the water reservoir 1110 and may be pumped out the outlet nozzle 1130. These apertures, 1312 for example, may be located within the bottom portion 1311 and/or the bell end 1310.

In some embodiments, the water flow channel 1320 may comprise a hollow cylinder coupled with the outlet nozzle 1130. In some embodiments, the outlet nozzle 1130 may have a substantially flat top and bottom portions and cylindrical aperture that is coupled with the water flow channel 1320. The outlet nozzle 1130 may also have a width that expands along the length of the outlet nozzle 1130 from a smaller areal cross-section to a larger areal cross section.

In some embodiments, the axial flow pump housing can be shaped with a bell end 1310. The bell end 1310 may be shaped to improve water flow into the axial flow pump housing. For example, the bell end 1310 may improve uniformity of the water as water enters the axial flow pump housing from the water reservoir 1110. The axial flow pump housing may also include guide vanes 1410 as shown in FIG. 12. In some embodiments, the guide vanes 1410 may extend along an axis of the axial flow pump housing that is generally in the path of the water when the axial flow pump is in operation. The guide vanes 1410, for example, may include any number of vertical components. The guide vanes 1410, for example, may include between 3 and 6 vertical components. The guide vanes 1410, for example, may be coupled to an inner surface of an wall of the axial flow pump housing. The guide vanes 1410, as another example, may not be coupled to the inner surface of the wall of the axial flow pump housing. The guide vanes 1410, for example, may interact with an element of the inner surface of the out wall of the axial flow pump housing such that the guide vanes are restricted from rotating.

In some embodiments, the bell end 1310 may be elevated from a floor of the water reservoir 1110 by one or more supports or the bottom portion 1311. The one or more supports may couple the axial flow pump housing to the water reservoir 1110 via horizontal components and/or vertical components. Additionally or alternatively, the axial flow pump housing may be mounted to a cap of the water reservoir 1110 (e.g., via the axial flow pump housing) and/or suspended above the floor of the water reservoir 1110.

In some embodiments, the bell end 1310 may have generally smooth curve along an edge of its cross section. In some embodiments, the bell end 1310 may be implemented with any shape that narrows along an axis that generally follow the flow of water through the axial flow pump housing. In some embodiments, water may enter the bell end 1310 from all 360 of the surface of the bell end 1310. This could possibly help reduce vortices and turbulence in the water. The bell end 1310 may be shaped like a bell and/or may have a diameter that is larger than the diameter of the water flow channel 1320. In some embodiments, the bell end 1310 may include grooves on the inside of the bell end 1310, which may possibly reduce the rotational influence of the axial flow pump.

Figure 15:
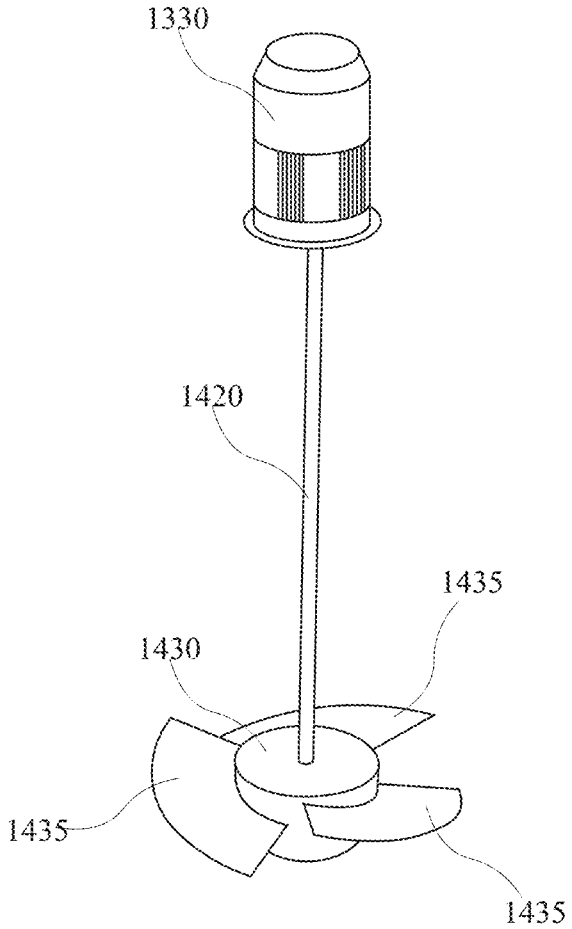
FIG. 15 is an illustration of an example axial flow pump motor and impeller according to some embodiments.

FIG. 15 is an illustration of an example axial flow pump motor 1330 (e.g., electric motor 102) and impeller 1430 (e.g., impeller 124) according to some embodiments. In some embodiments, the axial flow pump motor 1330 may be coupled with the impeller 1430 via a drive shaft 1420 (e.g., shaft 118). In some embodiments, the axial flow pump may include a shaft seal (e.g., shaft seal 114) to maintain a seal between the axial flow pump motor 1330 (e.g., at the drive shaft 1420) and a surface of the axial flow pump housing. The axial flow pump motor 1330 may also include one or more reduction gears, pulleys, or belts. The one or more reduction gears may be used to adjust a rotation rate of the drive shaft 1420 and impeller 1430.

The axial flow pump motor 1330 may be configurable for operation at multiple speeds, which may be characterized by a rotation speed of the impeller 1430 such as, for example, a rotation per minute (RPM); or may be characterized by the flow rate of the water that is driven through the intake, such as, for example, volume per second; or a linear speed of water as it axial flow pump propels the water through a portion of the axial flow pump housing, the nozzle 1130, or the water flow channel 1320 such as, for example, volumes per second.

The axial flow pump motor 1330 may be a combustion engine or an electrical engine. In some implementations, the axial flow pump motor 1330 may be powered via a connection to a battery, which may in turn be charged via a renewable power supply such as a solar panel. The axial flow pump motor 1330 may be positioned above an upper surface of the axial flow pump housing and/or above the water surface 1220.

In some embodiments, the axial flow pump motor 1330 may be positioned to the side of the axial flow pump housing. In some embodiments, the axial flow pump motor 1330 may be positioned horizontally with respect to the flow of the water through the water flow channel.

The drive shaft 1420 may extend along a path of the water flow when the axial flow pump is in operation. The drive shaft 1420 may extend along a path of the water flow through one or more of the plurality of portions.

The impeller 1430 may be attached to the drive shaft 1420, which may rotate to spin the various blades 1435 of the impeller 1430. The drive shaft 1420 may extend from a hub of the impeller 1430, through the intake and to the axial flow pump motor 1330. In some embodiments, the drive shaft 1420 may extend past a bulkhead at an end of axial flow pump housing, through a shaft seal (e.g., shaft seal 114) and to the axial flow pump motor 1330. In some embodiments, the blades 1435 of the impeller 1430 may be attached to an impeller hub and extend outwardly toward an inside wall of the axial flow pump housing. The blades 1435 may be shaped so that the impeller provides thrust on the water when rotated to draw water further into the axial flow pump housing. For example, the impeller may direct water along a path that is generally parallel with the drive shaft 1420.

In some embodiments, the diameter of the impeller 1430 may be about the same diameter as an inner diameter of the axial flow pump housing and/or an inner diameter of the water flow channel 1320 and/or an inner diameter of the axial flow pump housing. In some embodiments, the impeller 1430 may be shaped to create a force on the water that draws it at least partially in a vertical direction and further into the axial flow pump housing. In some embodiments, the impeller 1430 may draw the water in a horizontal direction or another direction that influences the water to be drawn farther into the axial flow pump housing. The impeller 1430 may, for example, have a bell-shaped dome on the bottom side and/or directly over the hub to help draw the water more efficiently around the impeller 1430 and into the axial flow pump housing. The impeller 1430 may, for example, be flat or have another shape that may help draw water around the hub and into the axial flow pump housing.

In some embodiments, the impeller 1430 may comprise a metal such as, for example, brass, stainless, nickel, aluminum, and bronze. In some embodiments, the impeller 1430 may comprise a composite material with one or more laminate and/or fiber layers.

In some implementations, the axial flow pump 1160 may be coupled with a controller that can control the speed of the axial flow pump motor 1330. The controller may control power or to the axial flow pump such that it achieves the requested operational speed. For example, the controller may receive an input requesting a flow rate of 20 cubic feet per second. The controller may increase or decrease power to the axial flow pump until the controller receives input (e.g., from a sensor within the wave flow apparatus). Alternatively, the controller may receive an input to increase or decrease a flow rate, responsive to which the controller correspondingly increases or decreases power to the axial flow pump.

Figure 16:
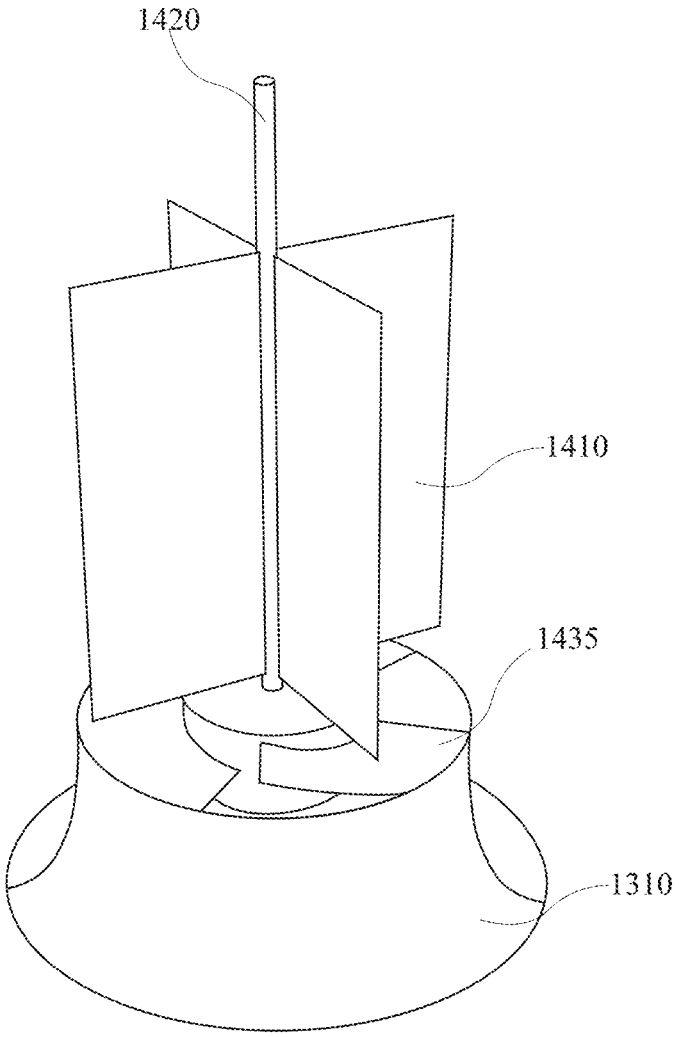
FIG. 16 is an illustration of a guide vane structure disposed within the axial flow pump housing according to some embodiments.

FIG. 16 is an illustration of a guide vane structure 1410 that may be disposed within the axial flow pump housing according to some embodiments. In some embodiments, the guide vane structure may be in positional context with an optional bell end 1310, the impeller 1430, and/or the drive shaft 1420. In some embodiments, the guide vane structure 1410 may include one or more guide vanes, which may, for example, reduce a rotational flow of water that is generated by the rotating the impeller 1430. The guide vane structure 1410, for example, may comprise a rust-resistant material, such as a polymer coating over a metallic material. The guide vane structure 1410, for example, may be restricted from rotating by being coupled to an interior surface of the axial flow pump housing. The guide vane structure 1410, for example, may be restricting from rotating by interacting with a structure of the interior surface of the axial flow pump housing that extends inwardly toward the drive shaft 1420.

Unless otherwise specified, the term "substantially" means within 5% or 10% of the value referred to or within manufacturing tolerances. Unless otherwise specified, the term "about" means within 5% or 10% of the value referred to or within manufacturing tolerances.

The conjunction "or" is inclusive.

The claimed invention is not limited to the above features and advantages. Those of ordinary skill in the art will recognize additional features and advantages upon reading the following detailed description, and upon viewing the accompanying drawings.

Modifications and other embodiments of the disclosed invention(s) will come to mind to one skilled in the art having the benefit of the teachings presented in the foregoing descriptions and the associated drawings. Therefore, it is to be understood that the invention(s) is/are not to be limited to the specific embodiments disclosed and that modifications and other embodiments are intended to be included within the scope of this disclosure. Although specific terms may be employed herein, they are used in a generic and descriptive sense only and not for purposes of limitation.

What is claimed is:

1. An axial flow pump for an activity pool, the axial flow pump comprising:

a water reservoir;

a pump body disposed within the water reservoir, the pump body comprising:

a main body having a substantially cylindrical shape with a top, a bottom, and an axis that extends from the bottom to the top;

a shaft seal disposed at or near the top of the main body;

a water flow intake disposed at or near the bottom of the main body;

a water flow output disposed at or near the top of the main body; and a bell end disposed at the water flow intake, the bell end has a diameter that is greater than a diameter of the main body, and wherein the bell end has a longitudinal length that is substantially less than a longitudinal length of the main body;

an impeller disposed within the bell end of the pump body;

an electric motor disposed external to the pump body and external to the water reservoir;

a shaft that is coupled with the electric motor, extends into the pump body through the shaft seal in a direction along the axis, and is coupled with the impeller such that the electric motor rotates the impeller causing water to flow into the pump body through the water flow intake and forcing the water to exit the pump body through the water flow output; and a plurality of guide vanes disposed within the pump body that extend along the main body along the axis from the water flow intake toward the water flow output, the plurality of guide vanes reduce a rotational flow of water that is generated by the impeller when the impeller is rotating.

2. The axial flow pump according to claim 1, wherein the water reservoir comprises a water fill level indicating the level where water fills the water reservoir;

wherein the electric motor is disposed above the water fill level;

wherein the pump body is disposed below the water fill level.

3. The axial flow pump according to claim 1, wherein the water reservoir is at least partially filled with water and wherein the electric motor is not disposed within the water and the pump body is disposed within the water.

4. The axial flow pump according to claim 1, further comprising one or more shaft supports disposed within the pump body and coupled with the shaft to allow the shaft to rotate and remain aligned between the electric motor and the impeller.

5. The axial flow pump according to claim 1, wherein the impeller comprises one or more metals from the group consisting of brass, stainless, nickel, aluminum, and bronze.

6. The axial flow pump according to claim 1, wherein the impeller comprises a non-metal composite material.

7. The axial flow pump according to claim 1, wherein the impeller comprises an impeller flange and a plurality of impeller blades, the impeller flange is coupled with the shaft and the plurality of impeller blades.

8. The axial flow pump according to claim 1, wherein the shaft is disposed perpendicular relative to the direction of the water flow as the water exits the pump body via the water flow output.

9. An axial flow pump for an activity pool, the axial flow pump comprising:

a pump body comprising:

a main body having a substantially cylindrical shape having a top, a bottom, and an axis that extends from the bottom to the top;

a shaft seal disposed at or near the top of the main body;

a water flow intake disposed at or near the bottom of the main body;

a water flow output disposed at or near the top of the main body; and a bell end disposed at the water flow intake, the bell end has a diameter that is greater than a diameter of the main body, and wherein the bell end has a longitudinal length that is substantially less than a longitudinal length of the main body;

an impeller disposed within the bell end;

an electric motor disposed external to the pump body; and a shaft that is coupled with the electric motor, extends into the pump body through the shaft seal in a direction along the axis; and is coupled with the impeller such that the electric motor rotates the impeller causing water to flow into the pump body through the water flow intake and forcing the water to exit the pump body through the water flow output.

10. The axial flow pump according to claim 9, further comprising one or more shaft supports disposed within the pump body and coupled with the shaft to allow the shaft to rotate and remain aligned between the electric motor and the impeller.

11. The axial flow pump according to claim 9, wherein the impeller comprises one or more metals from the group consisting of brass, stainless, nickel, aluminum, and bronze.

12. The axial flow pump according to claim 9, wherein the impeller comprises a non-metal composite material.

13. The axial flow pump according to claim 9, wherein the impeller comprises an impeller flange and a plurality of impeller blades, the impeller flange is coupled with the shaft and the plurality of impeller blades.

14. The axial flow pump according to claim 9, wherein the shaft is disposed perpendicular relative to the direction of the water flow as the water exits the pump body via the water flow output.

15. The axial flow pump according to claim 9, further comprising a water reservoir;

wherein the water reservoir comprises a water fill level indicating the level where water fills the water reservoir;

wherein the electric motor is disposed above the water fill level;

wherein the pump body is disposed below the water fill level.

16. The axial flow pump according to claim 9, further comprising a water reservoir; wherein the water reservoir is at least partially filled with water and wherein the electric motor is not disposed within the water and the pump body is disposed within the water.

* * * * *